US005235724A

United States Patent [19]

Perrin et al.

[11] Patent Number: 5,235,724

[45] Date of Patent: Aug. 17, 1993

[54] ROLLER-HINGE ASSEMBLY FOR RETRACTABLE OVERHEAD DOOR

[76] Inventors: Donald E. Perrin, 1960 128th Street, Surrey, British Columbia, Canada, V4A 3V4; Perrin L. Halley, 12952 20th Avenue, Surrey, British Columbia, Canada, V4A 1Z1

[21] Appl. No.: 756,535

[22] Filed: Sep. 9, 1991

[51] Int. Cl.[5] ..... A47H 15/00; E05D 11/00; E05D 15/06

[52] U.S. Cl. ..... 16/97; 160/201; 16/223

[58] Field of Search ..... 16/97, 104; 160/223, 160/201, 209

[56] References Cited

U.S. PATENT DOCUMENTS

| | | | |
|---|---|---|---|
| 1,897,391 | 2/1933 | Kelly | 160/209 |
| 1,990,870 | 2/1935 | Kelly | 160/209 |
| 2,059,585 | 11/1936 | Kelly | 160/209 |
| 2,827,115 | 3/1958 | Stroup | 160/201 |
| 2,869,637 | 1/1959 | Schacht, Jr. . | |
| 3,060,491 | 10/1962 | Pemberton et al. | 16/97 |
| 4,095,641 | 6/1978 | Olson | 160/201 |
| 4,115,900 | 9/1978 | Mihalcheon . | |
| 4,119,133 | 10/1978 | Wolf | 160/209 |

FOREIGN PATENT DOCUMENTS

| | | | |
|---|---|---|---|
| 278210 | 11/1964 | Netherlands | 160/201 |

*Primary Examiner*—John Sipos
*Assistant Examiner*—Carmine Cuda
*Attorney, Agent, or Firm*—Barrigar & Oyen

[57] ABSTRACT

This invention pertains to a retractable roller-hinge assembly for use with retractable overhead doors. More particularly, this invention relates to a novel roller-hinge assembly which when installed on conventional retractable overhead doors, such as garage doors warehouse doors or truck doors, enables the door panels to pull away more quickly from the door frame as the overhead door is raised, or lowered. A hinge assembly for connecting upper and lower panels of a retractable overhead door comprising: (a) upper devices for securing to the upper panel; (b) lower devices adapted for securing to the lower panel, the lower devices being hingedly connected by a pivotal axis to the upper devices; (c) roller and roller axle devices rotatably connected to the upper devices, said roller and axle devices being adapted to move towards the lower devices as the upper devices are pivoted about the pivotal axis.

5 Claims, 7 Drawing Sheets

ROLLER-HINGE ASSEMBLY FOR RETRACTABLE OVERHEAD DOOR

FIELD OF THE INVENTION

This invention pertains to a retractable roller-hinge assembly for use with retractable overhead doors. More particularly, this invention relates to a novel roller-hinge assembly which when installed on conventional retractable overhead doors, such as garage doors warehouse doors or truck doors, enables the top door panels to pull away from the top area of the door frame as the overhead door is raised.

BACKGROUND OF THE INVENTION

There are numerous designs of overhead or retractable door assemblies which are commonly used for garage doors, truck doors, and warehouse doors. Such retractable overhead garage doors are conventionally constructed of a number of vertically arranged horizontal panels which can fold along the horizontal divisions between the panels, thereby enabling the doors to assume a rolled or folded configuration as they pass along a curved path before being retracted into the ceiling of the building in which they are installed. The panels assume a vertically juxtaposed planar configuration when lowered into a bottom position to thereby present a solid face and close the door opening.

Such retractable overhead doors typically are constructed of a number of stacked horizontal panels, with two or more hinge assemblies between each of the adjacent horizontal panels. The hinge assemblies at each side of the door run in parallel tracks which are installed vertically on each side of the door, and curve at the top before becoming horizontal parallel tracks, suspended from the ceiling of the building. Such doors can be manually operated, or can be automatically operated by using infra red or radio operated motors, which pull the panels of the door upwardly along the tracks, when the door is being opened, or push the door downwardly to a closed position, when reversed.

The following three patents disclose alternative types of overhead door assemblies:

| U.S. Pat. No. | Inventor | Issue Date |
|---|---|---|
| 2,827,115 | Stroup | March 18, 1958 |
| 2,869,637 | Schacht, Jr. | January 20, 1959 |
| 4,115,900 | Mihalcheon | September 26, 1978 |

Stroup discloses an upwardly acting door assembly including a plurality of door sections comprising outer and inner panels of sheet metal. The outer panel has inwardly offset upwardly facing angled flanges on its upper and lower edges. The inner panel has outwardly offset downwardly facing angled flanges on its upper and lower edges. The flanges of the panels are in interlocking engagement and coact to provide an outwardly facing rabbet on the lower edges. The rabbets of adjacent sections coact to provide a stepped joint. Two separate reinforcing rails of a length corresponding approximately to the length of the panels and of a thickness corresponding to the spacing of the panels is disposed horizontally between the panels adjacent their upper and lower edges. The rails are of double channels section with reversely facing channels. One rail is inverted with respect to the other to provide outwardly facing channels at the top and bottom of the door section with the webs of the channels lapped against and secured to the interior surfaces of the inner and outer panels. Vertically extending flanges on the edges of the rails are lapped against the interior surface of the adjacent panels of the sections. The rails and panels are fixedly secured together. Coacting hinge members are disposed on the inner sides of adjacent sections and are provided with pintles disposed in the plane of the upper step of the joint. The hinge members are formed of sheet metal and are secured to the ends of the rails disposed between the panels. The hinge members are secured to the sections by fasteners disposed therethrough and through the rails.

Schacht, Jr. discloses in an upwardly acting door assembly including a track comprising an upright section, a horizontal section and a curved intermediate section merging into the upright and horizontal sections. The door comprises a plurality of panels. A first hinge member is mounted on the inner side of the lower edge of the upper panel of a pair of adjacent panels considered from the relative position of the panels when the door is closed. The member has a pair of spaced inwardly projecting flanges, the lower ends of which project beyond the lower edge of the upper panel. A pintle is disposed through the flanges with its axis in the central plane of the joint between the panels. A second hinge member is mounted on the inner side of the lower panel of the pair and is provided with an inwardly offset knuckle engaging the pintle on the first hinge member. The track roller is provided with a spindle journaled in the inwardly projecting flanges of the first hinge member and positioned substantially above the pintle so that the upper edge of the lower panel of the pair is not substantially elevated above the track as the track roller traverses from the curved intermediate track section onto the horizontal section, or vice versa.

Certain retractable door designs have the side rails installed at an angle so that the door panels approach the door frame as the door panels are lowered into position. This design ensures that the door panels are moved against the door frame when the retractable door is in a lowermost closed position. This design, however, requires hinges of different design at various panel elevations on the door in order to accommodate the different distances from the side rails to the door frame. These hinges are typically numbered from #1 to #10 to accommodate most designs of retractable door. A conventional garage door typically uses hinges numbering from #2 to #4, or sometimes #5.

Mihalcheon provides a single hinge which can be modified and locked into position to act as any one of a conventional #1 hinge, through to a conventional #10 hinge. Mihalcheon's hinge design can be adjusted to mimic a hinge having any number of hinged plates. A pair of upstanding bearing support ears extend outwardly from one of the plates. A bearing member is provided comprising a tubular support portion, for receiving the shaft of a roller, and an arm portion. Means are provided for disengageably connecting and locking the end of the arm portion, remote from the support portion, to the support ears. Thus, the arm can be rotated about its connection with the ears, to vary the distance of the support portion relative to the plates. The hinge can then be locked in place to fix the position of the roller relative to the sectional door.

Mihalcheon specifically discloses a hinge and roller support device for a sectional door. The hinge comprises a pair of plates hinged together end to end and adapted to be attached to the door. One of the plates has a pair of spaced bearing support ears upstanding therefrom. Each ear forms a transverse bolt-receiving aperture spaced above the plate. A bearing member comprises a tubular support portion, for receiving the shaft of a roller, and an arm portion of generally right-angled configuration extends from the support portion. The arm portion comprises a tongue portion, extending from the tubular support portion, and a pair of spaced apertured lugs projecting from the side edges of the tongue portion at its end remote from the tubular support portion. The lugs form the right angles with the tongue portion, whereby, when the elements are assembled, the apertures of the lugs are located adjacent to and in alignment with the ear apertures. Threaded bolt means are used for connecting the support ears and the lugs by extension through the adjacent pairs of apertures. Nut means threadable on the bolt means permit disengageable locking of the bearing member to the support ears, whereby the arm portion can be rotated about the bolt means to vary the distance of the tubular support from the plates and then be fixed in place by tightening only the bolt and nut means.

None of these patents disclose a hinge design which permits the door to be pulled away quickly from the door frame as the door is being raised, or moved toward the door frame when the door is lowered.

SUMMARY OF THE INVENTION

The invention is directed to a hinge assembly for connecting upper and lower panels of a retractable overhead door comprising: (a) upper means for securing to the upper panel; (b) lower means adapted for securing to the lower panel, the lower means being hingedly connected by a pivotal axis to the upper means; (c) roller and roller axle means rotatably connected to the upper means, said roller and axle means being adapted to move towards the lower means as the upper means is pivoted about the pivotal axis.

The upper means of the hinge assembly can have at each side thereof, protruding flanges which extend in the same direction, the flanges being adapted to hold the roller and axle means. The pivotal axis can extend between the flanges and the roller axle means can extend between the flanges and be parallel to the pivotal axis. The pivotal axis and the roller axle means can be spaced from one another.

The upper means of the hinge assembly can be pivotally connected to the lower means by a first tube secured to the lower means, which first tube can pivot inside a larger diameter second tube attached to the upper hinge assembly. The roller and roller axle means can pivot inside a tube which is connected at each end to the flanges, the tube being arranged in parallel with the first and second tubes of the hinge assembly.

The invention is also directed to an attachment for a retractable overhead garage door assembly having upper and lower panels, and rollers adapted to roll in a guideway, and a hinge assembly having upper and lower hinge means for respectively connecting to the upper and lower panels together comprising: (a) connector means for attachment to a side of the upper panel, said connector means being adapted to have secured therethrough the upper hinge means of the hinge assembly; and (b) flange means associated with the connector means extending adjacent the lower panel, said flange means including rotatable bearing means adapted to receive an axle and the roller adapted to roll in the guideway.

The connector means of the attachment can have a right angle shape adapted to fit on the front and side of the upper panel of the overhead door. The connector means can have holes in the main body thereof, adapted to receive bolts for securing the attachment to the upper panel.

The invention is also directed to an attachment for a retractable overhead garage door assembly having upper and lower panels, and rollers adapted to roll in a guideway, and a hinge assembly having upper and lower hinge means for respectively connecting to the upper and lower panels together comprising: (a) plate means for attachment to an outer surface of an upper base plate of the upper hinge means which is attached to the upper panel; and (b) flange means associated with the plate means and extending at an angle from one end thereof, said flange means including rotatable bearing means adapted to receive an axle and the roller adapted to roll in the guideway.

BRIEF DESCRIPTION OF THE DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

In the assembly of a sectional retractable, overhead door, the horizontal door sections or panels are connected together by vertically positioned hinge plates spaced along the side edge portions thereof. Since the door slides vertically and horizontally along parallel spaced roller guide tracks mounted on the interior of the building, it is conventional to mount a roller on the side of each hinge plate to connect the track and door panels.

Figure 3:
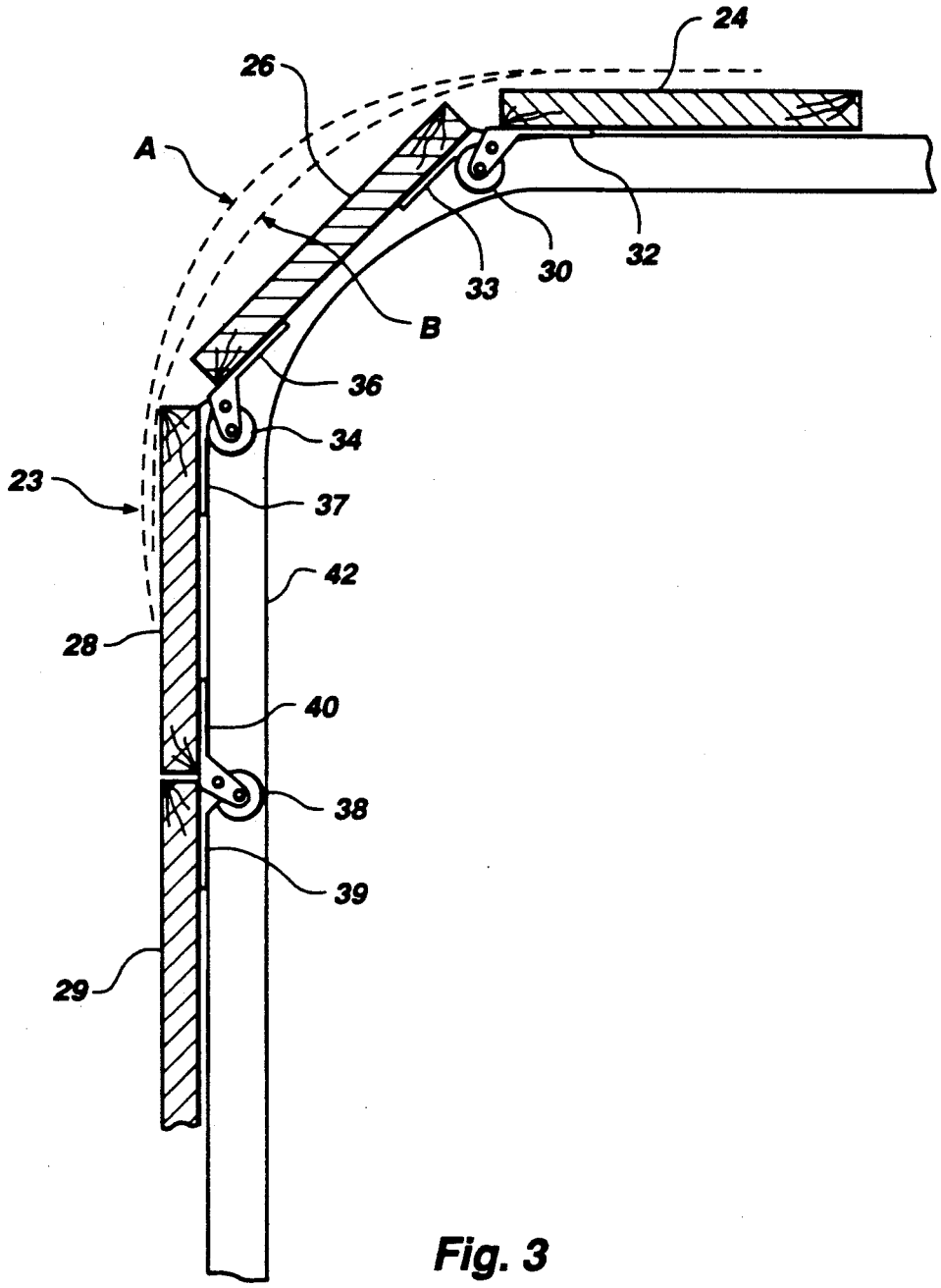
FIG. 3 illustrates a side view of a conventional overhead garage door assembly including roller guide tracks and hinges with rollers between door panels.

In most modern retractable overhead door constructions, it is customary to have the rising leg of each track inclined slightly away from the door jamb or frame. To accommodate this, it is necessary that the rollers of successively hinge assemblies are spaced further and further away from the attached hinge plates, so that the door sections adopt a vertical position when closing the door opening. FIG. 3 illustrates this configuration in a side view of a conventional overhead garage door assembly. As illustrated in FIG. 3, the lower portion of the trackway 42 is angled somewhat (to the left as shown in FIG. 3) in order to assist in pulling the door panels away from the upper region of the door frame as the door is raised, or alternatively, move the panels against the door frame as the door is lowered. It will be noted that the distance of the top roller 30 from the hinge base 33 is greater than for lower roller 34 from the hinge base 37. In turn, the distance of roller 34 from the base of hinge body 37 is greater than the distance of lowest roller 38 from base 39.

Heretofore the hinge and roller support devices used in the retractable overhead door industry have tended to be of two types. One type can be said to have a fixed bearing for receiving the roller and the other has a bearing whose position relative to the hinge plates can be adjusted. Both types comprise a pair of plates hinged together end to end.

Figure 1:
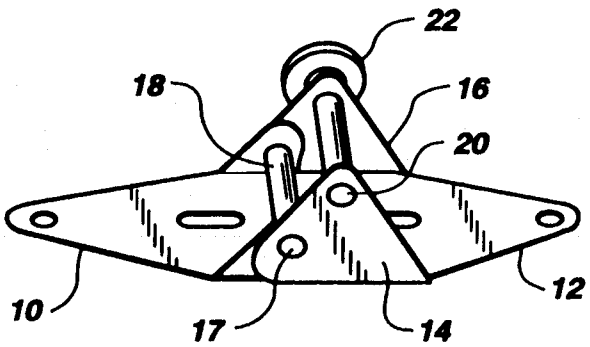
FIG. 1 illustrates an isometric view of a conventional overhead garage door hinge in extended position.
Figure 2:
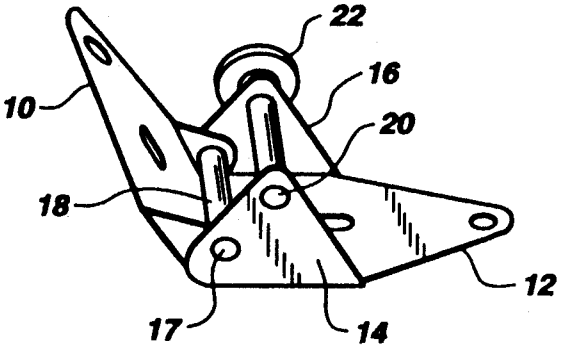
FIG. 2 illustrates an isometric view of a conventional garage door hinge in folded 90° position.

In the case of the first type, FIGS. 1 and 2 illustrate isometric views of such a hinge design. FIG. 1 shows the hinge in extended position, while FIG. 2 shows the hinge in folded position. A pair of spaced, upstanding, apertured ears 14 and 16 extend outwardly (upwardly) from the side edges of one of the hinge plates 12. A horizontal tube 18 extends through the apertures and is fixed to the ears to provide a stationary bearing for the roller shaft 20. A shortcoming of this type of device is that to accommodate the inwardly angled roller guide rails, each of the required hinge units at the section junctures are different. Each must have its tube 18 spaced outwardly from the plates 10 and 12 a different distance when compared to its neighbours. Therefore it is necessary to keep in stock a different hinge unit for each section junction of the door to be installed. These are typically numbered from #1 through to #10.

To overcome this difficulty, an adjustable hinge has been marketed which involves forming one of the vertical hinge plates to provide an outwardly extending bracket having a transverse, horizontal wall. Outwardly directed parallel slots are provided in this horizontal wall. A separate bearing member is then slidably mounted on the bracket. Bolts are inserted through the slots and apertures and nuts are threaded thereon to clamp the tongue portion of the bearing member to the bracket wall at the desired location.

This type of hinge unit also has shortcomings. Particularly, it is expensive to construct and is difficult to install, because the nuts and bolts have to be tightened from above and below under cramped conditions.

Specifically, FIGS. 1 and 2 illustrate isometric views of a conventional overhead garage door hinge and roller assembly. FIG. 1 illustrates the conventional hinge assembly in extended position. FIG. 2 illustrates the conventional hinge in folded position. The roller 22 and pin 20 are rotatably secured to ears 14 and 16 while hinge 18 and pin 17 connect the upper base 10 to the lower base 12. When installed, this hinge must have the roller 22 positioned at a slightly lower elevation and interior of the hinge 18 and pin 17. If the hinge is installed upside down, then the door binds as it is raised or lowered through the curved portion of the track, and hence is virtually inoperable.

As mentioned previously, residential overhead retractable garage doors are usually divided into four to six horizontal sections or panels which bend along horizontal fold lines between the panels. FIG. 3 illustrates a side view of a portion of a typical overhead garage door. At each fold line, between panels 24, 26, 28 and 29, there is a hinge (30, 36, 40) near either side edge of the door (in closed position) and sometimes in between, if the door is wide enough to require middle hinges. These middle hinges do not have rollers which run in jacks. The hinges at the outer vertical edges of the door support bearings and axles (42, 44 and 46) for the rollers 30, 34 and 38 that guide the sides of the doors in a roller guideway 42 that in its lower section is generally vertical (although vertically tilted slightly to the right as seen in FIG. 3) and then curves upwardly and inwardly along the garage ceiling to become inwardly horizontal so that the door may be moved upwardly out of the way overhead, or alternatively lowered from its overhead position downwardly into closed position. The hinges 32, 36 and 40 conveniently support the rollers 30, 34 and 38 which have to be located in the vicinity of the hinge to keep the horizontal door panels 24, 26, 28 and 29 properly in alignment as the door is moved upwardly or downwardly. These hinges vary slightly in appearance, depending upon the vertical position of the hinge relative to the door.

In each case, as seen in FIGS. 1 and 2, the conventional hinge has an upper base portion 10 and a lower base portion 12. The upper portion 10 is screwed to the upper panel while the lower portion 12 is secured to the lower panel. The lower hinge base portion 12 is provided with trunnion brackets 18 in which a hinge pin 17 and a roller bearing support 20 for a roller 22 are mounted. The upper hinge element 10 pivots relative to lower hinge element 12 about hinge pin 17. It is necessary for proper operation of the garage door that when the hinge elements are flat against the door, as shown in FIG. 1, roller bearing mount 20 must be located downwardly and spaced outwardly from the plane of the garage door relative to the hinge pin 17. In other words, bearing 20 must be located above and to the right of pin 17, as seen in FIG. 1. However, when installed, with the door closed, the hinge shown in FIG. 1 would be turned 90° to assume a vertical position.

FIG. 2 shows the configuration of the conventional hinge arrangement of FIG. 1 when the garage door is in angled or folded position about the hinge pin 17. This folded position is assumed as the hinge and roller 22 are passing through the curved portion of guideway 42 as shown in FIG. 3.

The particular hinge shown in FIGS. 1 and 2 is the one between the two uppermost panels comprising the residential overhead garage door. This is known in the trade as a #3, 4 or 5 hinge. It is found that often there is tendency for the roller 22 mounted on this particular hinge, to bind in the curved part of the track or guideway 42. The problem is particularly acute where the top of the garage door frame, and therefore the surrounding doorway, is not cleanly rectangular but is angled or curved around the top edges, for cosmetic purposes. This presents the possibility of a minor obstruction which causes binding between the door and the frame, or a propensity to increase the amount of friction presented as the door moves around the curved part of the track 42 at the top part of the door, just prior to the fully closed position of the door as the door is closing (or just after the door begins to open, when the door is opening). The problem is aggravated when there are major changes in humidity or temperature which cause distortions in the panels and door frames.

Figure 4:
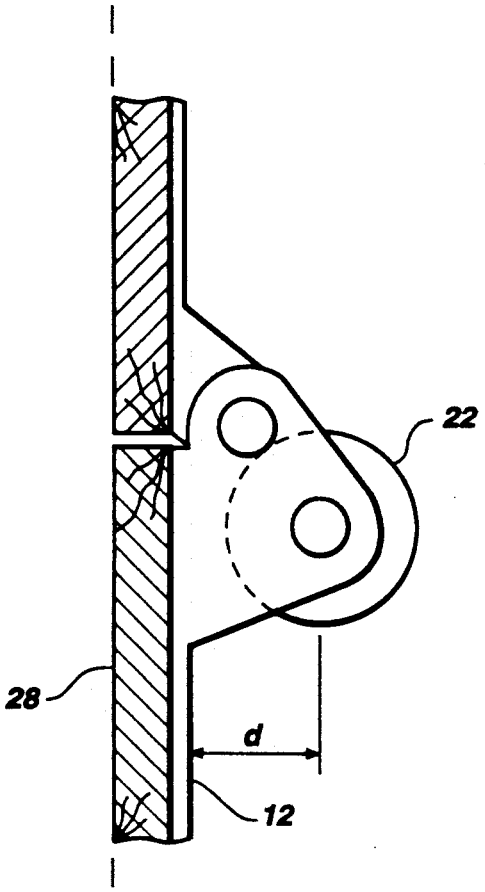
FIG. 4 illustrates a side view of a conventional overhead garage door hinge in vertical extended position.
Figure 5:
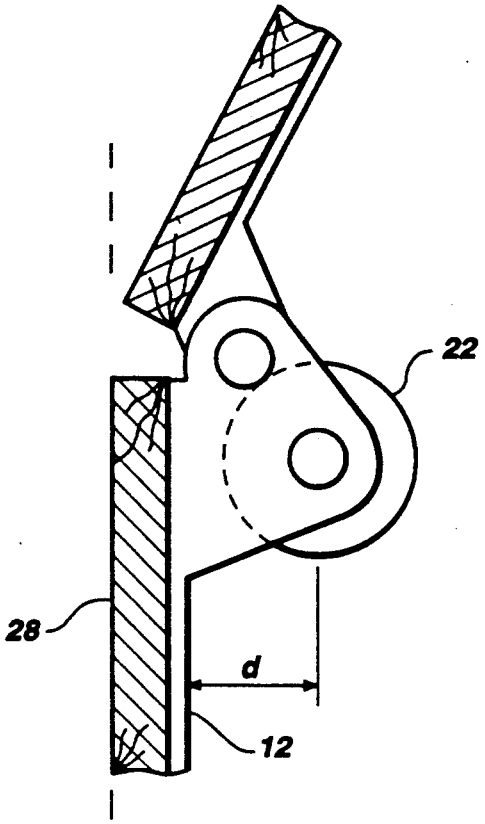
FIG. 5 illustrates a side view of a conventional overhead garage door hinge as the hinge first starts to fold to about a 30° position.

FIGS. 4 through 7 inclusive illustrate in sequence, the respective positions of a conventional overhead garage door hinge, and roller, as the hinge and door are raised (or lowered) through the curved part of track 42. In FIG. 4, the door is at its lowermost position, and accordingly the panels are in vertical alignment. In FIG. 5, as the door panels begin to reach the curved portion of the track 42 illustrated in FIG. 3, the hinge begins to fold. However, it is important to note that the distance "d" between the axle of the roller and the lowermost door panel remains the same in FIGS. 4 and 5.

Figure 6:
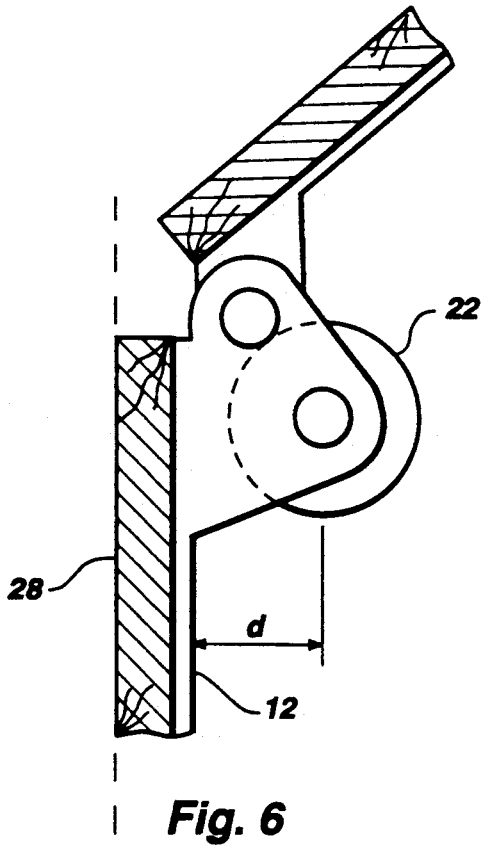
FIG. 6 illustrates a side view of a conventional overhead garage door hinge folded about 45°.
Figure 7:
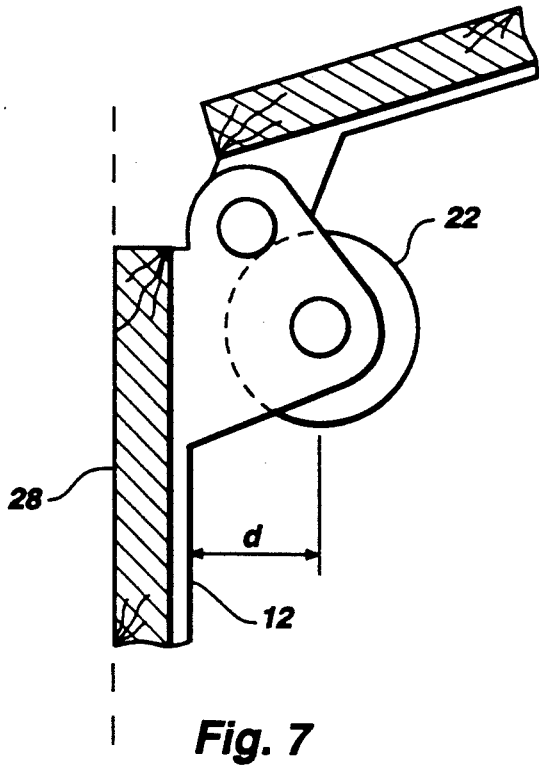
FIG. 7 illustrates a side view of a conventional overhead garage door hinge folded about 75°.

FIGS. 6 and 7 illustrate subsequent more folded positions for the conventional door hinge, as the upper portions of the curved trackway 42 are reached. Again, it is significant to note that the horizontal distance "d" from the axle of the roller to the lower door panel remains constant.

In summary, FIGS. 4 through 7 inclusive, which depict a conventional overhead door hinge in extended position, and in successive folded positions of 30°, 45° and 60°, demonstrate that the distance (d) from the 22 to the lower plate 12 remains the same regardless of the fold position. Thus, the door panel 28 remains a fixed distance from the roller 22 (and hence the roller guideway 42, which is not shown in FIGS. 4 through 7) since the lower door panel 28 is secured directly to the lower plate 12.

This constant distance "d" feature of conventional overhead door hinges is a serious handicap because the lower door panel tends to bind with the door frame at the most critical location, namely, at the upper curved track region, where forces are the greatest, and binding can occur due to warpage of the door panel, or variations in moisture content of the door panels, or door frames due to climatic changes. The problem is particularly acute in doorway constructions where the upper regions of the door frame are curved or angled, for cosmetic effect.

Figure 8:
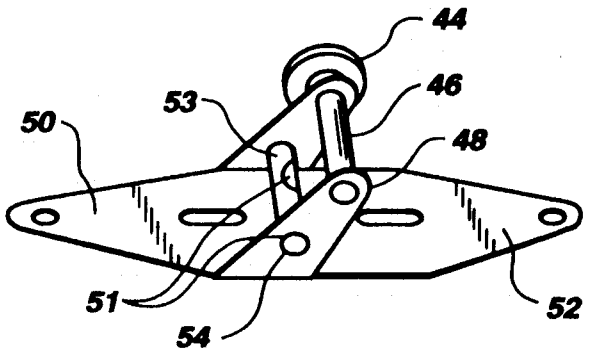
FIG. 8, which appears on the same sheet as FIGS. 1 and 2, illustrates an isometric view of a retractable overhead garage door hinge according to the invention, in extended position.
Figure 9:
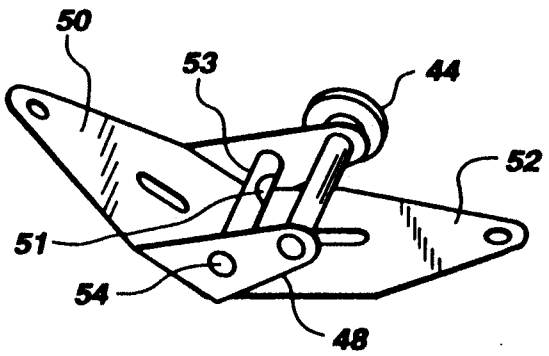
FIG. 9, which appears on the same sheet as FIGS. 1 and 2, illustrates an isometric view of a retractable overhead garage door hinge according to the invention folded in a 90° position.

FIG. 8, which appears on the same sheet as FIGS. 1 and 2, illustrates an isometric view of a retractable overhead garage door hinge according to the invention, in extended position. FIG. 9, which appears on the same sheet as FIGS. 1 and 2, illustrates an isometric view of a retractable overhead garage door hinge according to the invention folded in a 60° position.

According to the invention, the bearing for the roller 44 is provided in a trunnion bracket mounting 48 (roller bearing) that is affixed to the upper hinge base 50 instead of to the lower hinge base 52, as is the case with a conventional hinge. The hinge 54 is constructed of an outer tube 53 connected to a lower hinge base 52 and an inner concentric tube 51 connected to the two bracket mountings 48. The requirement that the roller bearing 48 be mounted downwardly and away from the plane of the garage door relative to hinge point 54 is preserved in the invention. This enables the new hinge design to fit with existing hardware. It can therefore be installed in new door systems, or retrofitted into existing systems, without requiring major changes. The geometrical configuration of the hinge of the invention as shown in FIGS. 8 and 9, as a static configuration, is identical to the geometric configuration of the conventional hinge shown in FIGS. 1 and 2, as a static configuration. It is only when the dynamics of the folding operation occur, that a difference comes into play between the conventional hinges shown in FIGS. 1 and 2 and the hinge of the invention shown in FIGS. 8 and 9. The location of pin 54 relative to the two hinge portions 50 and 52 in FIG. 8 is identical to the conventional hinge shown in FIG. 1. The difference is that the bearing for rotatably mounting the axle 46 for roller 44 is now in a portion of the hinge structure that is fixed to and supported by upper hinge base 50, rather than lower hinge element 52.

This significant difference between a conventional hinge and the hinge of the invention becomes apparent the garage door panels fold about the respective hinge axis. Referring to FIG. 9, which shows the 60° folded or angled position of the hinge structure according to the invention, it can be seen that as the upper hinge base 50 pivots about pivot axis 54 relative to the lower hinge base 52, the roller bearing 46 for roller 44 pivots with the upper hinge base 52 about hinge axis 54 and, consequently, the roller 44 moves closer to the lower hinge base 52. Hence the plane of the garage door panel (not shown) to which lower hinge base 52 is attached is closer to roller 44 than was the case when the two hinge bases 50 and 52 were flat (in extended position) as appears in FIG. 8. By contrast, in the conventional roller hinge arrangement in FIGS. 1 and 2, the roller 22 always remains at the same distance ("d") above the flat of the door panel to which the lower hinge base is attached, as can be perceived by the fact that in the conventional hinge arrangement, there is no change in position of roller bearing 20 relative to the door panel to which lower hinge base 12 is attached, as appears in FIGS. 1 and 2.

This movement of the roller bearing 46 toward the door panel to which the lower hinge base 52 is attached as the hinge breaks or folds (which occurs when the roller reaches the curved part of the track 42 as shown in FIG. 3), draws the panel inwardly away from the door frame and affords a much smoother passage of the door 23 about the curved portion of the guideway 42 for the rollers 44 and tends to avoid any binding of the rollers 44 within the track 42, or binding of the door 23 against the door frame.

Figure 10:
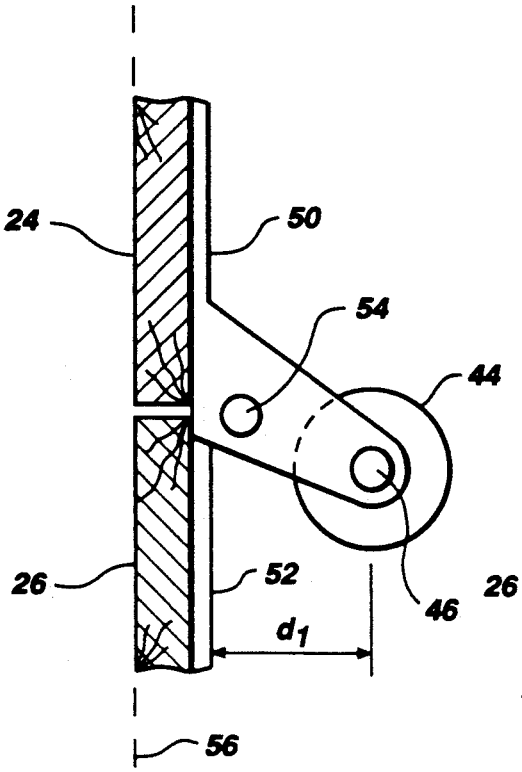
FIG. 10 illustrates a side view of an overhead garage door hinge according to the invention, in extended upright position.
Figure 11:
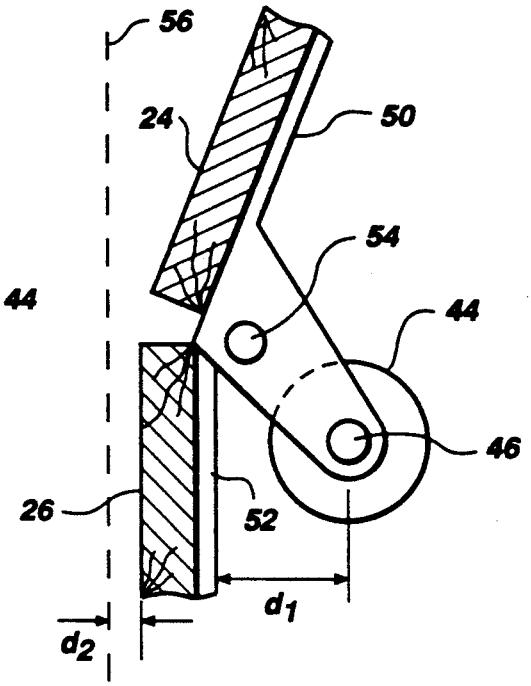
FIG. 11 illustrates a side view of an overhead garage door hinge according to the invention, folded about 20°.

FIGS. 10 through 13 inclusive show in sequence, in side view, the manner in which the overhead door hinge of the invention breaks or folds as the door 23 is raised through the curved portion of the roller track 42 (see FIG. 3). In FIG. 10, the upper panel 24 and lower panel 26 are in vertical alignment, as are the upper hinge base 50 and lower hinge base 52, and the roller 44 is at a certain distance "$d_1$" from the lower hinge base 52 and the lower door panel 26. The door frame 56 is indicated by the broken line. In FIG. 11, as the hinge begins to travel through the curved portion of the guideway track 42, and begins to fold, the distance "$d_1$" between the roller 44 and the lower hinge base 52 and door panel 26 decreases a certain extent, while a distance represented by "$d_2$" begins to appear between the lower panel 26 and the door frame 56.

Figure 12:
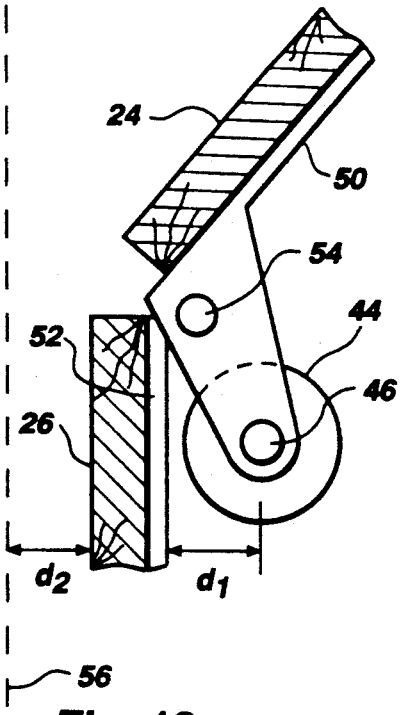
FIG. 12 illustrates a side view of an overhead garage door hinge according to the invention, folded about 45°.
Figure 13:
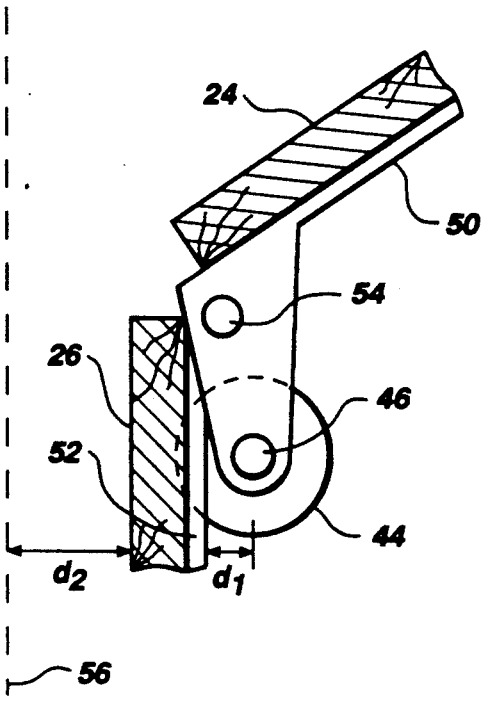
FIG. 13 illustrates a side view of an overhead garage door hinge according to the invention, folded about 60°.

In FIG. 12, which shows the overhead door hinge folded to a greater extent (45°) at a more upwardly position in the track 42 curvature, the distance "$d_1$" from the roller 44 to the lower door panel 26 is even less than shown in FIG. 11. Likewise, the distance "$d_2$" between the panel 26 and the door frame 56 has increased proportionately. FIG. 13 illustrates further the manner in which the distance "$d_1$" between the roller 44 and the lower door panel 26 decreases, as the hinge is folded further (60°) while passing further through the curved portion of the roller guideway 42. Now, the distance "$d_2$" between the door frame 56 and the panel 26 has increased substantially.

The net effect of this decrease in distance "$d_1$", and increase in "$d_2$", is that the door panel 26 is drawn away from the door frame 56 and closer to the roller 44 and the roller trackway 42. Because of this drawing action, the likelihood of the door panels binding against the door frame, as the overhead door passes through the upper curved portions of the roller guideway 42, is substantially decreased or even eliminated.

The retracted path of panel travel created by the hinge of the invention is shown by dotted line B in FIG. 3. Dotted line A in FIG. 3 illustrates the path of panel travel with a conventional hinge. It is apparent that the retracted path B means there is less likelihood that the door panel edges will rub or impinge on the door frame, thereby eliminating a longstanding problem.

Figure 14:
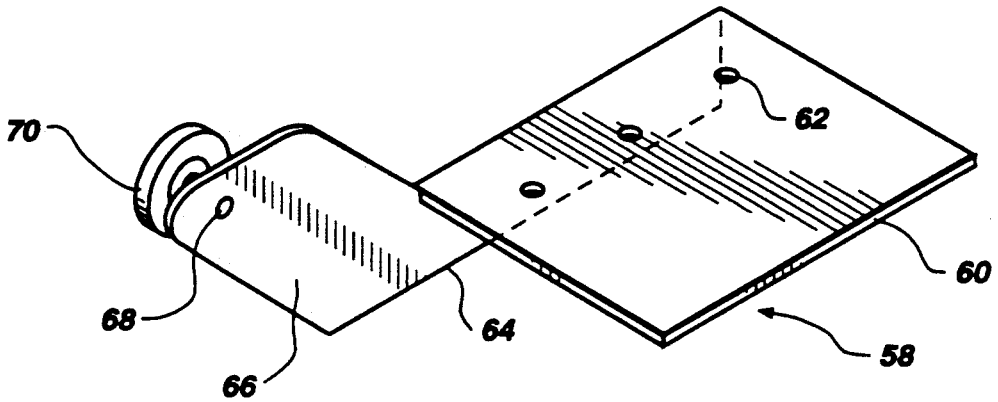
FIG. 14 illustrates an isometric view of an alternative overhead garage door assembly according to the invention, suitable for use in association with conventional retractable door hinges, installable on the left interior side of the door.

FIG. 14 illustrates an isometric view of an alternative embodiment of upper hinge plate, which applies the theory of the invention, but which can be used in association with conventional overhead garage door hinges (FIGS. 1 and 2), in order to enable the conventional overhead door hinges to pull the door panels away from the door frame, as the respective hinges pass through the curved portion of the roller guideways 42. The advantage of the construction illustrated in FIG. 14 is that the adapter plate can be installed on existing overhead garage door systems, while maintaining conventional retractable overhead door hinges.

FIG. 14 illustrates an adapter plate 58 which can be used on the left-interior side of an upper door panel. The adapter plate 58 comprises a flat base plate 60 which has screw or bolt holes 62 punched therein. A side of the plate 60 is bent to form a right angle flange 64. The flange extends into a bearing support 66, which is adapted to support roller pin 68 and roller 70, to the exterior of the plate 58, as seen in FIG. 14.

Figure 15:
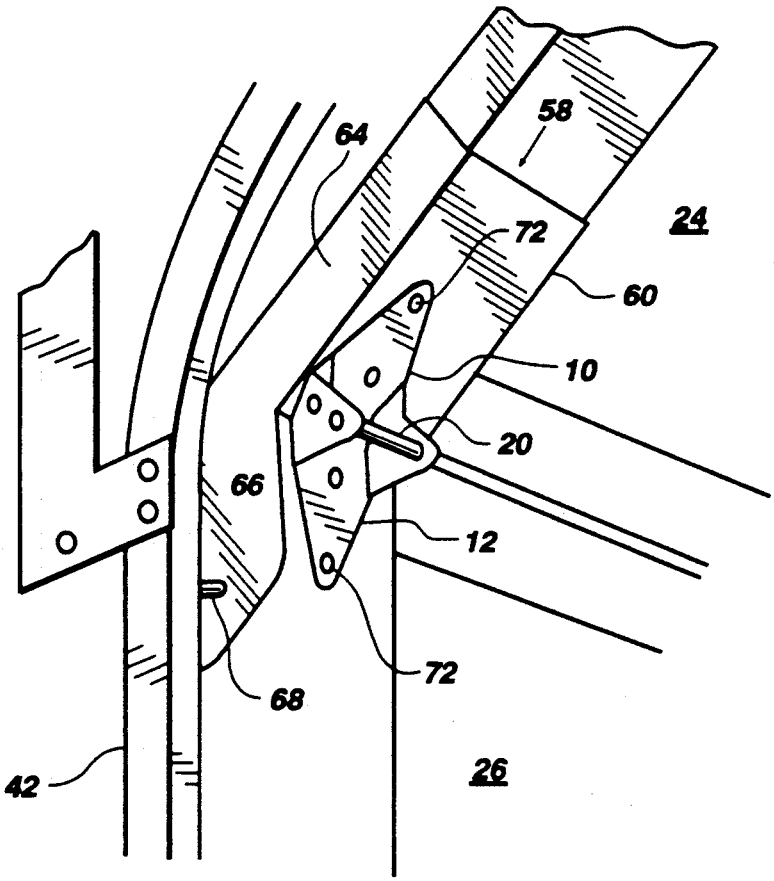
FIG. 15 illustrates an isometric view of the alternative hinge assembly illustrated in FIG. 14, installed on an overhead door and roller guide rail assembly.

FIG. 15 illustrates an isometric view of an adapter plate 58 installed on the upper panel 24 of a conventional overhead garage door, with a conventional overhead door hinge assembly comprising upper hinge base 10 and lower hinge base 12, bolted or screwed to the lower door panel 26. The conventional upper hinge plate 10 is bolted by bolts 72 to hold base plate 60 on the edge of upper panel 10. The lower hinge base 12 is bolted to the lower door panel 12 in the conventional way. The adapter plate 58 enables the roller (not visible) to be separated from the roller shaft 20 or the door hinge, and moved a certain distance away, thereby enabling the lower door panel 26 to pull away more rapidly from the door frame (not shown) according to the same mechanism illustrated and discussed above in association with FIGS. 10 through 13 inclusive.

Figure 16:
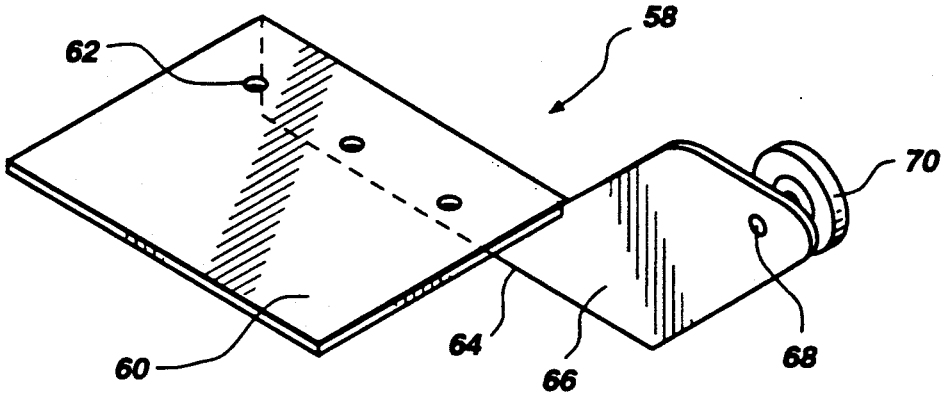
FIG. 16 illustrates an isometric view of an alternative overhead garage door assembly, similar to that illustrated in FIG. 14, but installable on the right interior side of the door.
Figure 17:
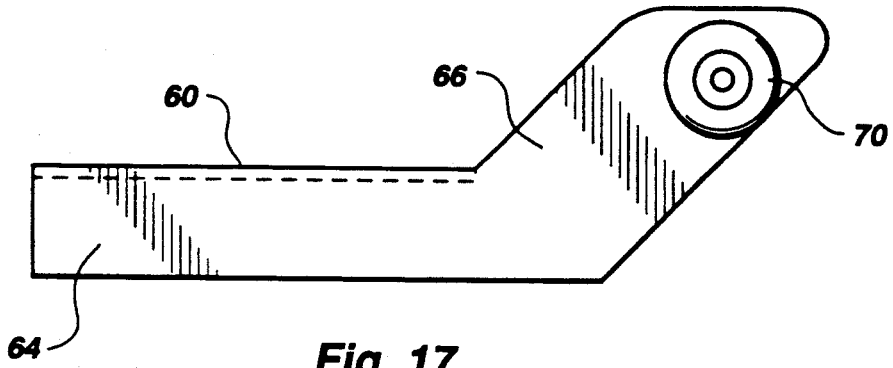
FIG. 17 illustrates a side view of the garage door assembly illustrated in FIG. 14.
Figure 18:
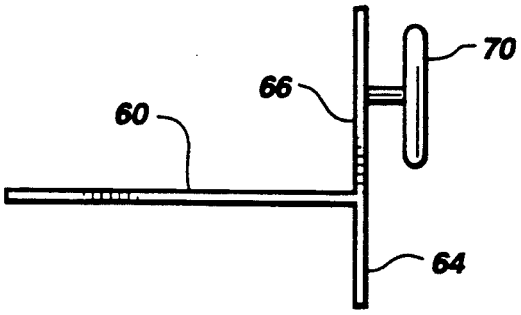
FIG. 18 illustrates an end view of the garage door assembly illustrated in FIG. 17.

FIG. 16 illustrates an isometric view of an adapter plate 58 for attaching to the upper panel on the right interior side of the retractable door. FIG. 17 illustrates a side view of the adapter plate 58 shown in FIG. 16 while FIG. 18 illustrates an end view of the adapter plate shown in FIG. 16. These drawings illustrate in detail the construction of the flange 64, bearing support 66, roller pin 68 and roller 70.

Figure 19:
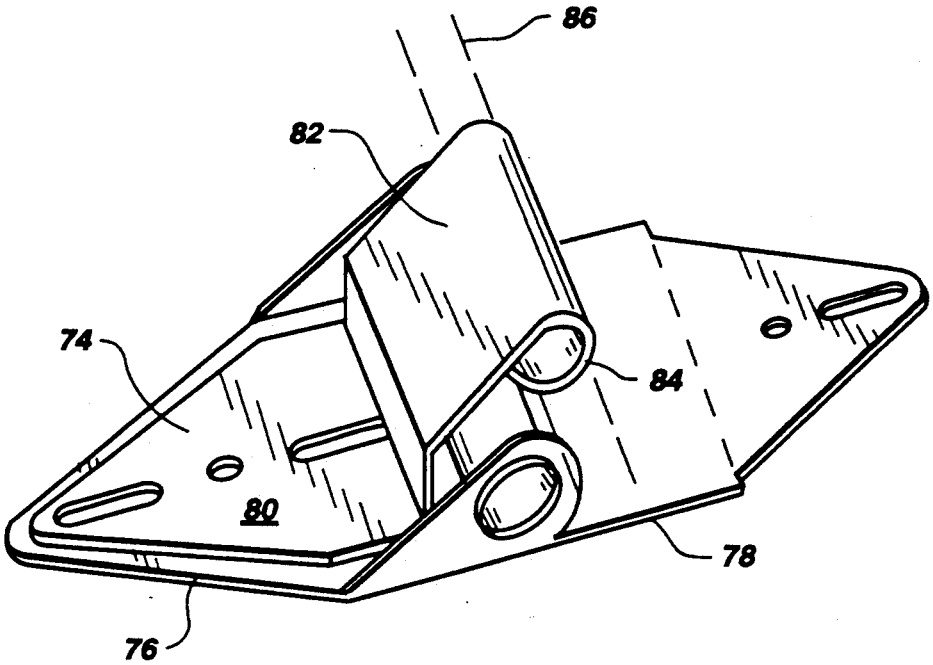
FIG. 19 illustrates an isometric view of an adapter and a standard garage door hinge, the combination implementing the principle of the invention.

FIG. 19 illustrates an isometric view of an adapter 74 which is fitted onto the upper base plate 76 of a standard single axle #1 garage door hinge 78 in order to adapt the standard hinge 78 to carry out the principle of the invention. As seen in FIG. 19, adapter 74 is constructed to have a base plate 80 which has screw or bolt holes therein which match the screw or bolt holes in the base plate 76 of the hinge 78. The adapter 74 also has formed therein a flange extension 82 which rises at an angle from the base plate and has formed in the upper end thereof a curled sleeve 84 which is adapted to receive the axle of a standard door roller 86 (shown in dotted lines). The combination of the adapter 74 and the hinge 78 duplicates in effect the hinge of the invention as illustrated in FIGS. 8 through 13. No. 1 hinges 78 are manufactured by automated techniques in large quantities and adapter 74 (which can also be manufactured by automated techniques) permits the principle of the invention to be carried out cheaply.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A hinge assembly for hingedly connecting an upper and a lower panel of a retractable overhead door when in a vertical orientation having rollers on each side travelling on respective tracks on each side, comprising:

(a) upper hinge means for securing to the upper panel, the upper hinge means having at each side thereof protruding flanges which extend in the same direction on the inside of the door, the flanges being adapted to hold between them roller axle means;

(b) lower hinge means for securing to the lower panel, the lower hinge means being hingedly connected to the upper hinge means by a pivotal axis connected to and extending between the flanges, said upper hinge means being pivotally connected to the lower hinge means by a first tube secured to the lower hinge means, and extending between the flanges, which first tube pivots inside a concentric larger diameter second tube attached to the upper hinge means and extending between the flanges; and (c) roller axle means spaced from the pivotal axis rotatably connected to the flange of the upper hinge means, and extending between the flanges parallel to the pivotal axis, said roller axle means having at each end exterior of the flanges, rollers which are adapted to roll on the respective track, the roller axle means being adapted to move towards the lower hinge means as the upper hinge means is pivoted towards the lower hinge means about the pivotal axis.

2. A hinge assembly as claimed in claim 1 wherein the roller and roller axle means pivot inside a tube which is connected at each end to the flanges, the tube being arranged in parallel with the first and second tubes of the hinge assembly.

3. An attachment for a retractable overhead garage door assembly having upper and lower panels with side edges, and rollers adapted to roll in a guideway, and a hinge assembly having upper and lower hinge means for respectively connecting to the upper and lower panels for converting and mounting said guideway rollers on said upper hinge means comprising:

(a) planar connector means having at least two holes therein for enabling attachment of the connector means to a side edge of the upper panel, said connector means terminating at the lower edge of the upper panel and being adapted to have secured therethrough the upper hinge means of the hinge assembly the hinge line of the upper and lower hinge means coinciding with the lower edge of the connector means; and (b) planar flange means connected at right angles with the connector means and extending on a side edge of the upper panel and to a point adjacent the side edge of the lower panel but separate from the lower panel, said flange means having rotatable bearing and roller means secured to the side of the flange means opposite the side adjacent said side edge adjacent the lower panel and below the hinge line of the upper and lower hinge means and the lower edge of the connector means, said roller being adapted to roll in the guideway.

4. An attachment for a retractable overhead garage door assembly having upper and lower panels when in a vertical orientation, and rollers adapted to roll in a guideway, and a hinge assembly having upper and lower hinge means for respectively connecting to the upper and lower panels for converting and mounting said guideway rollers on said upper hinge means comprising:

(a) plate means with holes therein adapted to receive bolts for attachment to an exterior surface of an upper base plate of the upper hinge means which is attached to the upper panel; and (b) flange means connected to the plate means at the end adjacent the lower hinge means and protruding from said end thereof on the same side as and adjacent to the upper hinge means, and beyond the hinge point of the upper and lower hinge means, said flange means including rotatable bearing means positioned parallel to and spaced from and beyond the hinge means and on the side of the hinge means opposite the upper panel adapted to receive an axle and a roller adapted to roll in the guideway.

5. An attachment as claimed in claim 4 wherein the rotatable bearing means is a hollow tube adapted to rotatably receive an axle.

* * * * *